US007094273B2

(12) United States Patent
Raymond et al.

(10) Patent No.: US 7,094,273 B2
(45) **Date of Patent: *Aug. 22, 2006**

(54) FABRICATION OF A HIGH-STRENGTH STEEL ARTICLE WITH INCLUSION CONTROL DURING MELTING

(75) Inventors: Edward Lee Raymond, Maineville, OH (US); Mark Alan Rhoads, Cincinnati, OH (US); Glenn Charles Culbertson, Mason, OH (US)

(73) Assignee: General Electric Company, Schenectady, NY (US)

( * ) Notice: Subject to any disclaimer, the term of this patent is extended or adjusted under 35 U.S.C. 154(b) by 209 days.

This patent is subject to a terminal disclaimer.

(21) Appl. No.: 10/773,362

(22) Filed: Feb. 6, 2004

(65) Prior Publication Data

US 2004/0206425 A1 Oct. 21, 2004

Related U.S. Application Data

(63) Continuation of application No. 10/109,995, filed on Mar. 28, 2002, now Pat. No. 6,692,550.

(51) Int. Cl.
*C21C 7/06* (2006.01)

(52) U.S. Cl. ..... 75/508; 164/57.1

(58) Field of Classification Search ..... 75/508, 75/567, 568; 164/57.1; 420/103, 590
See application file for complete search history.

(56) References Cited

U.S. PATENT DOCUMENTS 2,930,690 A 3/1960 Meinen
3,230,074 A 1/1966 Roy et al.
4,213,780 A 7/1980 Miller
4,414,023 A 11/1983 Aggen et al.
4,810,287 A 3/1989 Saka et al.
5,268,141 A 12/1993 Ototani et al.
5,393,488 A 2/1995 Rhoads et al.
5,945,067 A 8/1999 Hibner et al.
6,692,550 B1 * 2/2004 Raymond et al. ..... 75/508

FOREIGN PATENT DOCUMENTS

WO WO 99/31282 6/1999

* cited by examiner

*Primary Examiner*—Melvyn Andrews
(74) *Attorney, Agent, or Firm*—McNees Wallace & Nurick LLC

(57) ABSTRACT

A steel article is fabricated by providing an iron-base alloy having less than about 0.5 weight percent aluminum, melting the alloy to form a melt, adding calcium to the melt, thereafter adding aluminum to the melt to increase the aluminum content of the melt to more than about 0.5 weight percent aluminum, and casting the melt to form a casting. Other calcium additions may be made simultaneously with the adding of aluminum, and after the adding of aluminum but before casting the melt. The calcium additions deoxidize the melt to minimize the formation of clustered aluminum-oxygen-based inclusions.

14 Claims, 3 Drawing Sheets

FABRICATION OF A HIGH-STRENGTH STEEL ARTICLE WITH INCLUSION CONTROL DURING MELTING

This application is a continuation of application Ser. No. 10/109,995, filed Mar. 28, 2002, now U.S. Pat. No. 6,692,550 for which priority is claimed and whose disclosure is incorporated by reference.

This invention relates to the fabrication of an article made of a high-strength steel and, more particularly, to the control of aluminum-oxygen-based inclusions during melting and thence in the final article.

BACKGROUND OF THE INVENTION

In an aircraft gas turbine (jet) engine, air is drawn into the front of the engine, compressed by an axial-flow compressor, and mixed with fuel. The mixture is combusted, and the resulting hot combustion gases are passed through an axial-flow turbine. The flow of gas turns the turbine by contacting an airfoil portion of the turbine blade, which in turn provides power to the compressor. The hot exhaust gases flow from the back of the engine, driving it and the aircraft forward.

The various stages of the compressor and the turbine, as well as a turbofan if present, are mounted upon and linked together by shafts and shaft segments extending along the centerline of the gas turbine engine. Some of the shafts are made of high-strength steels. These shafts must have good strength, but equally importantly they must have good low-cycle-fatigue lives in torsion because of the types of loadings imposed upon the shafts.

Traditionally, the shafts had been made of maraging steels, which contain titanium nitride precipitates. After studies showed that these precipitates limit the low-cycle torsional fatigue lives, a family of high-strength, low-titanium maraging steels was developed. These steels are strengthened by aluminum additions on the order of from about 0.5 to about 1.3 weight percent, which replace the titanium additions of the earlier generation of steels. These higher-aluminum steels are described in U.S. Pat. No. 5,393,488, whose disclosure is incorporated by reference. The steels of the '488 patent result in significantly improved fatigue lives in the shafts.

However, an opportunity for improvement remains. There is an ongoing need to further increase the fatigue lives of the steels of the '488 patent, without adversely affecting the strength, toughness, and other properties of the steels, and without requiring major alterations to the processing parameters. The present invention fulfills this need, and further provides related advantages.

SUMMARY OF THE INVENTION

The present invention provides an improved melting and casting practice for high-aluminum steels such as those of the '488 patent. The new approach reduces the presence of inclusion clusters based on aluminum-oxygen compositions. Such clusters, when present, may serve as sites for the initiation of fatigue failure. The other desirable mechanical properties of the steels are not adversely affected by the practice of the present invention. The steels produced by the present approach find use as shafts for gas turbine engines and in other applications as well.

A method for fabricating a steel article comprises the steps of providing an iron-base alloy having less than about 0.5 weight percent aluminum, thereafter melting the alloy to form a melt, thereafter adding a first deoxidizer (preferably calcium) addition to the melt, thereafter adding aluminum to the melt to increase the aluminum content of the melt to more than about 0.5 weight percent aluminum, and thereafter casting the melt to form a casting.

The iron-base alloy initially provided desirably has less than about 0.5 weight percent aluminum, and preferably less than about 0.1 weight percent aluminum in order to use the preferred melting practice. In an embodiment, the as-provided iron-base alloy has from about 10 to about 18 weight percent nickel, from about 8 to about 16 weight percent cobalt, from about 1 to about 5 weight percent molybdenum, less than about 0.5 (and preferably less than about 0.1) weight percent aluminum, and from about 1 to about 3 weight percent chromium, balance iron and minor amounts of other elements. The aluminum addition desirably increases the aluminum content of the melt to from about 0.5 to about 1.3 weight percent aluminum. In an embodiment, the final casting desirably has from about 10 to about 18 weight percent nickel, from about 8 to about 16 weight percent cobalt, from about 1 to about 5 weight percent molybdenum, from about 0.5 to about 1.3 weight percent aluminum, from about 1 to about 3 weight percent chromium, up to about 0.3 weight percent carbon, less than about 0.1 weight percent titanium, balance iron and minor amounts of other elements.

In the usual case, the initially provided iron-base alloy has a relatively high carbon content, usually more than about 0.3 weight percent. It is preferred to melt the initially provided iron-base alloy in a vacuum furnace, gradually reducing the pressure while a carbon-oxygen chemical reaction (termed a carbon boil) occurs to reduce the oxygen content of the melt to less than about 10 parts per million by weight. The first calcium addition is then made, preferably in an amount of more than about 200 parts per million by weight. Optionally but preferably, there is an additional step, performed concurrently with the step of adding aluminum, of adding a second calcium addition to the melt, desirably in an amount of from about 100 to about 200 parts per million by weight. Optionally but preferably, there is an additional step, after the step of adding aluminum and before the step of casting, of adding a third calcium addition to the melt, desirably in an amount of from about 50 to about 150 parts per million by weight. Calcium additions are preferably made in alloy form, such as NiCa. The calcium additions deoxidize the melt during the period when aluminum-oxygen-based clustered inclusions would otherwise form, reducing the incidence of the formation of such clustered inclusions that, if present, compromise the low-cycle-fatigue performance of articles made of the steel.

The present steels are typically not used in an as-cast state, but are normally mechanically worked (including mechanical working and/or thermomechanical processing). In the application of most interest, the casting is mechanically worked to form a shaft of a gas turbine engine.

In a preferred embodiment, a method for fabricating a steel article comprises the steps of providing an iron-base alloy having more than about 0.3 weight percent carbon and less than about 0.1 weight percent aluminum, and thereafter melting the alloy in a vacuum furnace to form a melt. The step of melting the alloy includes gradually reducing the pressure within the vacuum furnace to induce a carbon boil in the melt, which reduces the oxygen content of the melt to less than about 10 parts per million by weight. A first addition of calcium is thereafter added to the melt in an amount of more than about 200 parts per million by weight. The method further includes thereafter simultaneously adding aluminum to the melt to increase the aluminum content of the melt to more than about 0.5 weight percent aluminum, and adding a second calcium addition to the melt in an amount of from about 100 to about 200 parts per million by weight. A third calcium addition is thereafter preferably made to the melt, preferably in an amount of from about 50 to about 150 parts per million by weight. The indicated amounts of the calcium additions are for typical cases. The amounts of the additions may be varied as necessary responsive to the amount of oxygen actually present in the melt, which may be readily measured by conventional real-time techniques. Other operable chemical oxidizers may be substituted for the calcium. The melt is thereafter cast, and the casting is mechanically worked. Consistent features discussed elsewhere herein are applicable to this embodiment.

In another embodiment, a method for fabricating a steel article comprises the steps of melting an iron-base alloy having less than about 0.5 weight percent aluminum while reducing the oxygen content of the melt to less than about 10 parts per million by weight. The step of reducing the oxygen content includes the step of adding a deoxidizer, such as calcium, to the melt. Aluminum is added to the melt to increase the aluminum content of the melt to more than about 0.5 weight percent aluminum; and thereafter the melt is cast to form a casting. Preferably, the melt initially has less than about 0.1 weight percent aluminum and more than about 0.3 weight percent carbon. Consistent features discussed elsewhere herein are applicable to this embodiment.

The compositions of the '488 patent achieved major improvements to the low-cycle-fatigue life of the steel by reducing the titanium content of the steel, thereby reducing the presence of titanium nitride inclusions. These inclusions were observed to be a source of the initiation of fatigue failures. The steels of the '488 patent are strengthened by the addition of aluminum in what are relatively large amounts for steels, on the order of 0.5–1.3 weight percent. The present inventors observed that fatigue failures in cast-and-worked final articles made of this and similar high-aluminum steels may initiate at aluminum-oxygen-based clustered inclusions (sometimes termed "rafts"). These aluminum-oxygen-based clusters have been traced back to the melting practice. When the high-aluminum steel alloy is melted prior to casting, the aluminum may form the aluminum-oxygen-based inclusion clusters in the molten steel. These inclusion clusters persist into the casting and then into the mechanically worked final product, leading to premature fatigue failure.

One potential approach to alleviating this problem is to add calcium to the high-aluminum steel melt immediately prior to casting. However, the present studies showed that the addition of calcium to the high-aluminum melt immediately before casting was not sufficient to avoid the presence of the aluminum-oxygen-based inclusions in the final product.

Instead, it has been found that the inclusion problem may be significantly reduced by first preparing the melt with a relatively low aluminum content, and then adding calcium prior to the addition of the remaining aluminum to bring the aluminum content to that desired in the final product, typically from about 0.5 to about 1.3 weight percent. Calcium is optionally but preferably added simultaneously with the aluminum addition as well. The elevated calcium content in the melt reduces the free oxygen available to form aluminum-oxygen based clusters. The calcium reacts with the free oxygen in the melt to form products wherein the oxygen is no longer free, such as calcium oxide and/or calcium aluminate. Further calcium may optionally be added after the aluminum is added to react with oxygen that may be introduced into the melt during the processing of the melt prior to casting. There is a reduced concentration of aluminum-oxygen-based clusters in the final product. Deoxidizers that are functionally equivalent to calcium may be used as well.

The result of this practice change is an improved low-cycle-fatigue life in the final articles produced from the steel. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
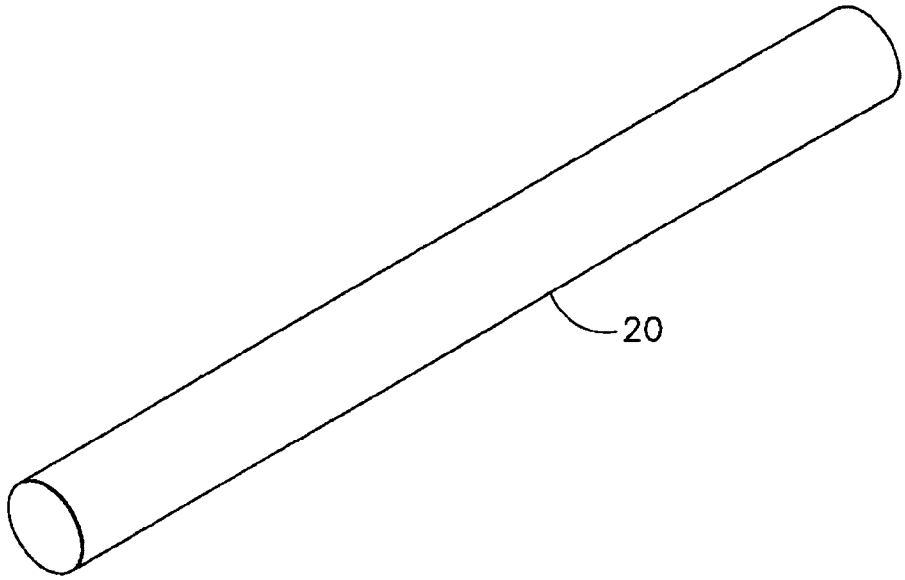
FIG. 1 is a perspective view of a shaft made from the steel of the invention.

FIG. 1 depicts an example of a steel article 20 that may be made by the approach of the invention. The article 20 is preferably a shaft used in a gas turbine engine. The use of the invention is not limited to this article, however.

Figure 2:
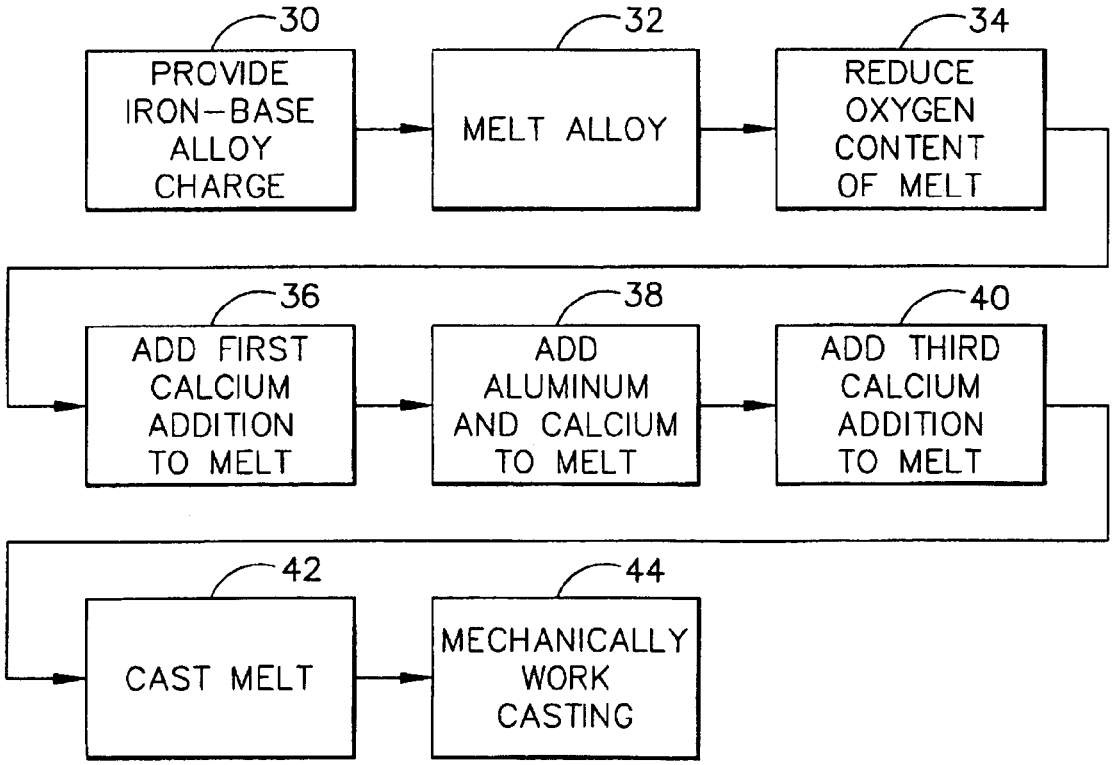
FIG. 2 is a block flow diagram of an approach for practicing the invention.

FIG. 2 illustrates in block diagram form a preferred approach for practicing the invention. An iron-base alloy is provided, numeral 30. The iron-base alloy has more iron than any other element. The iron-base alloy has aluminum present in a relatively small amount, less than about 0.5 weight percent and preferably less than about 0.1 weight percent. Other elements are typically present. In a preferred form, the iron-base alloy has from about 10 to about 18 weight percent nickel, from about 8 to about 16 weight percent cobalt, from about 1 to about 5 weight percent molybdenum, less than about 0.5 weight percent aluminum, and from about 1 to about 3 weight percent chromium. Carbon is ordinarily present in the initially provided iron-base alloy in an amount of more than about 0.3 weight percent, and the carbon content is reduced during the melting practice as will be described. Titanium is present, if at all, in an amount of less than about 0.1 weight percent. The remainder of the composition is iron, possibly other elements that are intentionally present, and impurities. (All compositions herein are weight percents, unless stated otherwise.)

The alloy is thereafter melted, numeral 32. Melting is preferably accomplished in a vacuum furnace at a pressure that ultimately reaches less than about 50 micrometers pressure. Most preferably, the vacuum furnace is a vacuum induction melting furnace using a crucible made of aluminum oxide or magnesium oxide.

The melting practice reduces the free oxygen content of the melt to a low level, numeral 34 of FIG. 2, so that there is little free oxygen available to react with aluminum to form the deleterious aluminum-oxygen based clustered inclusions. In the preferred approach, the free oxygen content is reduced by two main mechanisms. First, as the pressure in the vacuum chamber is reduced, the carbon and the free oxygen chemically react together to form gaseous carbon dioxide and carbon monoxide, which bubble out of the melt. This reaction and the bubbling may be quite agitated, leading to its description as a "carbon boil". The carbon boil does not occur appreciably if the aluminum content is too high, and for this reason the aluminum content of the initially provided melt is preferably less than about 0.1 weight percent. However, if other oxygen-reduction techniques are used at this initial stage of the melting, higher aluminum contents may be present. The free oxygen content of the melt is preferably less than about 10 parts per million by weight at the conclusion of step 34.

A first addition of a chemical deoxidizer, preferably calcium, is added to reduce the oxygen content of the melt even further, numeral 36 of FIG. 2. The calcium addition is preferably in an amount of more than about 200 parts per million by weight, an excess of calcium selected to react with and combine with substantially all of the free oxygen in the melt. The calcium may be added in any operable form that results in elemental calcium present in the melt. NiCa was used as the source of calcium in developing the present approach.

Aluminum is thereafter added to the melt, numeral 38, to the final desired aluminum content of the alloy. A preferred aluminum content of the alloy that is cast is from about 0.5 to about 1.3 weight percent. The chemical composition of other constituents of the melt may be adjusted to their desired final values at this time as well, based upon chemical analyses performed during the melting operation.

Preferably, a second chemical oxidizer addition, which is most preferably calcium, is made to the melt concurrently with the addition of aluminum in step 38. The second calcium addition is preferably from about 100 to about 200 parts per million by weight.

The first calcium addition in step 36, prior to the aluminum addition of step 38, and the concurrent second calcium addition in step 38, provide the chemical deoxidizer in the melt which chemically reacts with the free oxygen present in the melt to form compounds such as calcium oxide or calcium aluminate. These compounds do not tend to cluster. The free oxygen is no longer present to react with the extra aluminum added in step 38 to form aluminum-oxygen-based species that do tend to cluster, eventually producing undesirable clustered inclusions in the final cast product. In the absence of the present processing approach, such aluminum-oxygen-based clusters do form, leading to inclusions in the final product. The inclusions may serve as the initiation sites for premature fatigue failure.

Free oxygen tends to diffuse into the melt even under the vacuum of the vacuum melting furnace and during the subsequent casting process, possibly leading to the formation of aluminum-oxygen clusters. It is therefore preferred to make a third addition of calcium to the melt to chemically react with any free oxygen that is present, step 40 of FIG. 2, after the aluminum has been adjusted to its final value in step 38 and before or during the casting process of step 42. The third calcium addition is preferably in an amount of from about 50 to about 150, most preferably about 100, parts per million by weight.

The melt is thereafter cast and solidified, numeral 42. Any operable stationary-mold or continuous casting process may be used.

The preferred alloys are wrought alloys that are not used in an as-cast form. Instead, the casting is mechanically worked, numeral 44, to a final desired shaped, such as the shaft 20 of FIG. 1. The mechanical working 44 may involve working at room temperature, working at elevated temperature, or thermomechanical processing. Heat treatments may be used as necessary. Further details of preferred approaches to the working of the cast alloy are found in U.S. Pat. No. 5,393,488. A virtue of the present approach is that the same mechanical working treatments may be used in conjunction with the present approach as with the prior approaches to producing the articles.

Figure 3:
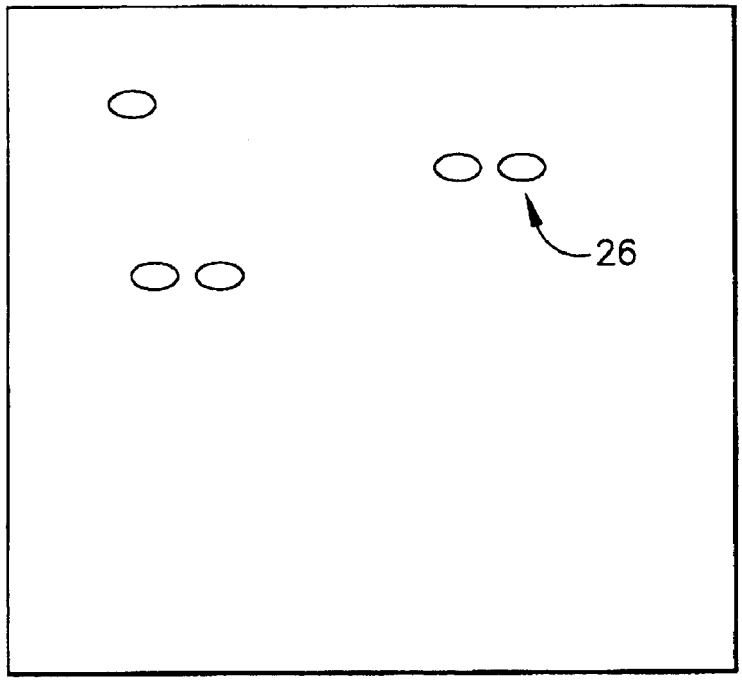
FIG. 3 is an idealized microstructure of the steel prepared according to the approach of FIG. 2.
Figure 4:
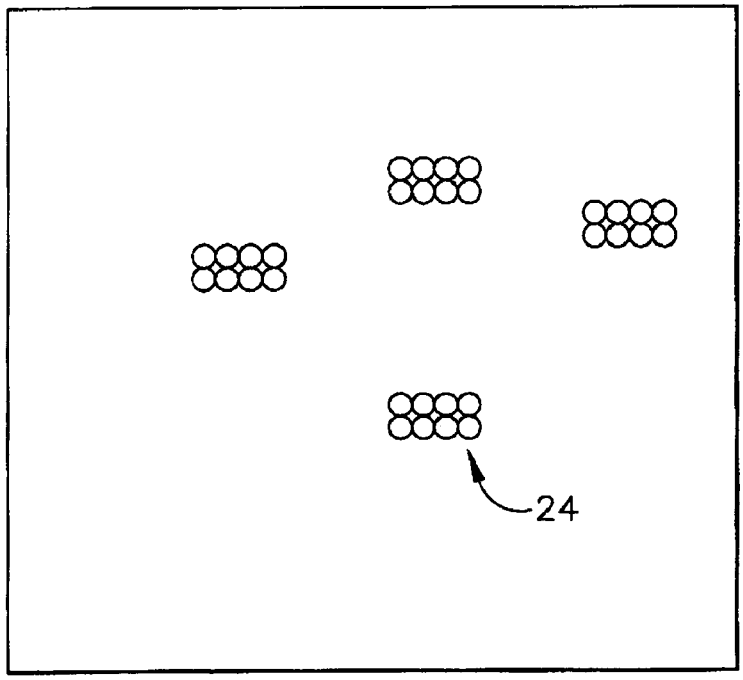
FIG. 4 is an idealized microstructure of the steel of the same composition as that shown in FIG. 3, but without the addition of calcium prior to the addition of aluminum.

FIGS. 3–4 are idealized microstructures of the article 20. The microstructure of FIG. 3 is for the material produced according to the invention, in which the first calcium addition 36 has been made. The microstructure of FIG. 4 is for the material produced without the first calcium addition 38 prior to the aluminum addition 38, and illustrates a product not within the scope of the invention. In this material of FIG. 4, there are aluminum-oxygen-based clusters 24 that function as inclusions scattered throughout the microstructure. These clusters 24 are quite large, with each typically have a planar area in the microstructure of hundreds of square microns. The large clusters 24 may serve as the origin for fatigue crack initiation, especially low-cycle-fatigue crack initiation, in the final product. By contrast, in the microstructure of FIG. 3, there are fine particles 26 present and distributed throughout the microstructure. The fine particles 26 are not clustered to a sufficiently large size that they produce a strong adverse influence on the low-cycle-fatigue properties of the final product by acting as crack initiation sites.

Figure 5:
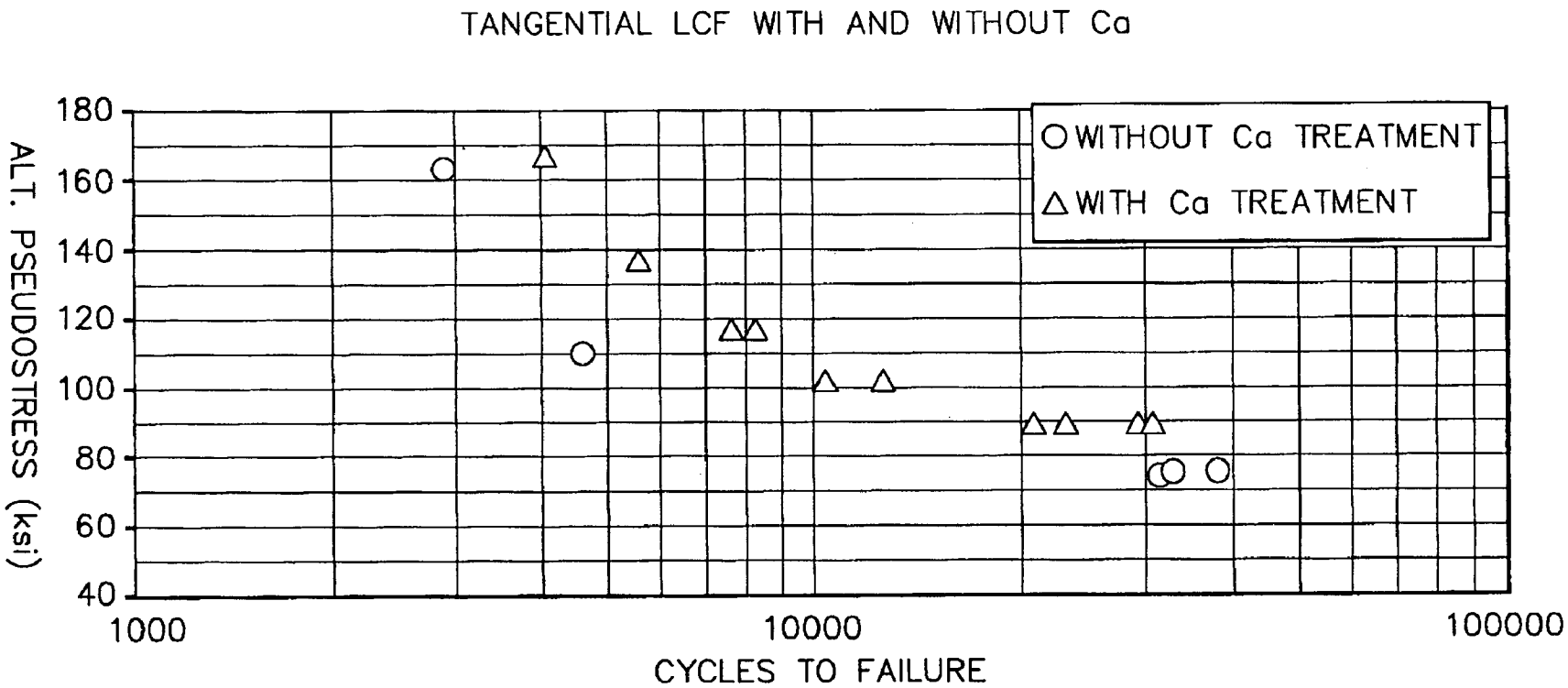
FIG. 5 is a graph of the alternating pseudostress as a function of cycles to failure in low cycle fatigue, with and without calcium additions.

The present approach has been reduced to practice. Comparative test results for the articles made with the calcium additions and without the calcium addition are shown in FIG. 5. The present approach using the calcium additions produces generally better fatigue results, particularly in the key low-cycle fatigue range toward the left-hand-side of the graph.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a steel article having more than about 0.5 weight percent aluminum, comprising the steps of providing an iron-base alloy; thereafter vacuum melting the alloy to form a melt, while reducing a free oxygen content of the melt to less than about 10 parts per million by weight; thereafter adding calcium to the melt; and thereafter casting the melt to form a casting having more than about 0.5 weight percent aluminum.

2. The method of claim 1, wherein the step of providing includes the step of providing the iron-base alloy having less than about 0.5 weight percent aluminum.

3. The method of claim 1, wherein the step of providing includes the step of providing the iron-base alloy having more than about 0.3 weight percent carbon.

4. The method of claim 1, wherein the step of vacuum melting includes the step of reducing the oxygen content of the melt by reacting the free oxygen with carbon.

5. The method of claim 1, wherein the step of adding calcium includes the step of adding calcium to the melt in an amount sufficient to react with all of the free oxygen in the melt.

6. The method of claim 1, wherein the method includes a step of adding aluminum to the melt to increase the aluminum content of the melt to more than about 0.5 weight percent aluminum, and wherein the step of adding calcium includes the step of adding calcium prior to the step of adding aluminum.

7. The method of claim 1, wherein the method includes a step of adding aluminum to the melt to increase the aluminum content of the melt to more than about 0.5 weight percent aluminum, and wherein the step of adding calcium includes the step of adding calcium concurrently with the step of adding aluminum.

8. The method of claim 1, wherein the method includes a step of adding aluminum to the melt to increase the aluminum content of the melt to more than about 0.5 weight percent aluminum, and wherein the step of adding calcium includes the step of adding calcium after the step of adding aluminum.

9. The method of claim 1, wherein the method includes a step of adding aluminum to the melt to increase the aluminum content of the melt to more than about 0.5 weight percent aluminum, and wherein the step of adding calcium includes the steps of adding a first calcium addition prior to the step of adding aluminum, adding a second calcium concurrently with the step of adding aluminum, and adding a third calcium addition after the step of adding aluminum.

10. The method of claim 1, wherein the step of casting includes the step of casting the melt to form the casting having from about 0.5 to about 1.3 weight percent aluminum.

11. The method of claim 1, including an additional step, after the step of casting, of mechanically working the casting.

12. The method of claim 1, including an additional step, after the step of casting, of mechanically working the casting to form a shaft.

13. A method for fabricating a steel article, comprising the steps of providing an iron-base alloy having less than about 0.5 weight percent aluminum; thereafter vacuum melting the alloy to form a melt; thereafter adding aluminum to the melt to increase the aluminum content of the melt to from about 0.5 to about 1.3 weight percent aluminum;

adding calcium to the melt; and thereafter casting the melt to form a casting.

14. The method of claim 13, wherein the step of vacuum melting includes the step of reducing a free oxygen content of the melt to less than about 10 parts per million by weight.

* * * * *